US009908683B2

(12) United States Patent
Tiesberger et al.

(10) Patent No.: US 9,908,683 B2
(45) Date of Patent: Mar. 6, 2018

(54) INJECTION-MOLDED CONTAINER FOR DRY STORAGE OF GOODS TO BE PACKAGED

(71) Applicant: Sanner GmbH, Bensheim (DE)

(72) Inventors: Kai Tiesberger, Sandhausen (DE); Matthias Schneider, Heidesheim (DE)

( * ) Notice: Subject to any disclaimer, the term of this patent is extended or adjusted under 35 U.S.C. 154(b) by 0 days.

(21) Appl. No.: 15/126,072

(22) PCT Filed: Mar. 9, 2015

(86) PCT No.: PCT/EP2015/054829

§ 371 (c)(1),
(2) Date: Sep. 14, 2016

(87) PCT Pub. No.: WO2015/135873

PCT Pub. Date: Sep. 17, 2015

(65) Prior Publication Data

US 2017/0096281 A1 Apr. 6, 2017

(30) Foreign Application Priority Data

Mar. 14, 2014 (DE) ..... 10 2014 103 565.8

(51) Int. Cl.
*B65D 85/00* (2006.01)
*B65D 81/26* (2006.01)
*B65D 43/16* (2006.01)

(52) U.S. Cl.
CPC ..... *B65D 81/268* (2013.01); *B65D 43/162* (2013.01); *B65D 2543/00296* (2013.01);
(Continued)

(58) Field of Classification Search
USPC ..... 220/802, 834; 206/528, 540
See application file for complete search history.

(56) References Cited

U.S. PATENT DOCUMENTS 2,690,861 A * 10/1954 Tupper ..... B65D 47/148 16/225
5,018,621 A * 5/1991 O'Connell, Jr. ..... A61J 1/03 206/204

(Continued)

FOREIGN PATENT DOCUMENTS

DE 10 2005 059 675 A1 6/2007
DE 10 2007 016 937 A1 10/2008

(Continued)

OTHER PUBLICATIONS

English Language abstract and machine-assisted English language translation of German Patent Publication No. DE 10 2005 059 675 A1 extracted from www.espacenet.com on Sep. 6, 2016; 12 pages.

(Continued)

*Primary Examiner* — Jacob K Ackun
(74) *Attorney, Agent, or Firm* — Giroux Amburn PC; Dean W. Amburn

(57) ABSTRACT

An injection-molded container for dry-storage of goods to be packaged, has a container body (2), which has a container wall (3) and forms a receiving space (4) for goods to be packaged. A desiccant is arranged in the receiving space (4). The container body (2) has, in an end region (5), an opening (6) for removing the goods to be packaged, and a closure (8) for closing the opening (6. The closure (8) has a lid (9) and a hinge (10) which forms a pivot axis (11), about which the lid (9) can be pivoted, in order to move the lid (9) between a closed position and an open position. The lid (9), the hinge (10) and the container body (2) are injection-molded in one piece. The lid (9) and the hinge (10) are formed and arranged on the container body (2) such that in the open position the lid (9) does not protrude beyond the end region (5) of the container body (2). The lid (9) has a sealing section (13), which, in the closed position of the lid (9), is arranged in the opening (6) of the container body (2). The sealing section (Continued)

(13) has a sealing surface (15), which, in the closed position of the lid (9), lies against the inner edge of the opening (6).

21 Claims, 6 Drawing Sheets

(52) U.S. Cl.
CPC ..... *B65D 2543/00518* (2013.01); *B65D 2543/00546* (2013.01); *B65D 2543/00842* (2013.01)

(56) References Cited

U.S. PATENT DOCUMENTS

| | | | | |
|---|---|---|---|---|
| 5,114,003 | A * | 5/1992 | Jackisch | B65D 81/268 206/204 |
| 6,571,942 | B2 * | 6/2003 | Riemenschneider | B65D 81/266 206/204 |
| 6,705,463 | B1 | 3/2004 | Bucholtz | |
| 2003/0155365 | A1 * | 8/2003 | Llorente Lecue | B65D 43/021 220/802 |
| 2006/0025718 | A1 | 2/2006 | Ostrowski | |
| 2010/0147864 | A1 | 6/2010 | Howes et al. | |
| 2011/0089187 | A1 | 4/2011 | Steiger et al. | |
| 2012/0043328 | A1 | 2/2012 | Pimer | |
| 2013/0256329 | A1 | 10/2013 | Belfance et al. | |

FOREIGN PATENT DOCUMENTS

| | | |
|---|---|---|
| WO | WO 2007 010174 A1 | 1/2007 |
| WO | WO 2012 082399 A1 | 6/2012 |

OTHER PUBLICATIONS

English Language abstract and machine-assisted English language translation of German Patent Publication No. DE 10 2007 016 937 A1 extracted from www.espacenet.com on Sep. 6, 2016; 10 pages.
German Search Report for German Application No. DE 10 2014 103 565.8 dated Apr. 2, 2014; 7 pages.
International Search Report for International Patent Application No. PCT/EP2015/054829 dated May 20, 2015; 2 pages.

* cited by examiner

INJECTION-MOLDED CONTAINER FOR DRY STORAGE OF GOODS TO BE PACKAGED

RELATED APPLICATIONS

This application is the National Stage of International Patent Application No. PCT/EP2015/054829, filed Mar. 9, 2015, which claims priority to and all the advantages of German Patent Application No. DE 10 2014 103 565.8, filed on Mar. 14, 2014, the entire contents of which are hereby incorporated by reference.

TECHNICAL FIELD

The present invention relates to an injection-molded container for dry-storage of goods to be packaged.

BACKGROUND

Containers comprising a desiccant are known. For example, DE 10 2007 016 937 A1 discloses a container for storing test strips comprising a housing with an opening and a lid. The housing accommodates an inner body, which can be moved relatively to the housing and which, during opening of the lid, can be drawn by actuating means in the direction of the opening. In order to fasten the container lid, the lid has latching tongues on its inner side.

A further previously known container is described in DE 10 2005 059 675 A1. The container has a closure section, which is connected to the cylindrical container body via a film hinge. A desiccant is provided in a chamber, which is arranged on the closure section. In the completely open position, the closure section also protrudes beyond the end region of the container body.

An object of the invention is to further develop a container such that it can be mechanically filled and handled in a particularly simple manner. Accordingly, provision is made that the lid and the hinge are formed and arranged on the container body such that in the open position, the lid does not protrude beyond the end region of the container body, wherein the lid has a sealing section which, in the closed position of the lid, is arranged in the opening of the container body, and wherein the sealing section has a sealing surface, which, in the closed position, lies against the inner edge of the opening.

SUMMARY

By virtue of the fact that the lid is configured such that it can be moved to a position, in which it does not protrude beyond the end region of the container body, mechanical handing and in particular mechanical filling of the container can be improved. It has been demonstrated that the filling procedure can then be performed in a particularly simple and reliable manner. In particular, guidance of the container is also improved during feeding to the filling machine. In this case, it is advantageous, if, in the open position, the lid is pivoted by 180° with respect to the closed position. The container can be sealed in a reliable manner by means of the sealing section of the lid. Moreover, the goods to be packaged can be protected by the desiccant against occurring moisture. Furthermore, the container can be operated easily and safely. The lid can be opened and then closed in a simple manner. This is assisted inter alia by the fact that the lid is connected to the container body via the hinge. In addition, the container, in which the lid, the hinge and the container body are injection-molded in one piece, is of high quality and can be produced cost-effectively at the same time. The pivot axis constitutes a notional axis, about which the lid can be pivoted. In this manner, container bodies, lids and hinges can be produced in one piece in a single method step and in particular do not have to be composed of individual parts. The hinge can preferably be formed as a film hinge. In this case, the flexible section of the film hinge forms the pivot axis. The container in accordance with the invention is particularly suitable for moisture-sensitive goods to be packaged, such as in particular medicaments and other medical products, e.g. test strips and diagnostic dipsticks, which can be arranged in the receiving space.

In accordance with one advantageous embodiment of the invention, provision is made that a distance A between the sealing surface and an outer boundary plane of the end region of the container body amounts to between 90% and 110% of a distance A' between the pivot axis and the outer boundary plane. The outer boundary plane is a (notional) plane, in which the outer edge of the end region of the container body is located. This arrangement contributes to the lid being able to be closed mechanically in a simple manner. Furthermore, effective sealing is also achieved. The boundary plane is arranged preferably perpendicularly with respect to the longitudinal axis of the container body. In accordance with the invention, it is preferred if the distance A equals the distance A'.

A further improvement in particular in mechanical handling is achieved by virtue of the fact that the container body has a holder, on which the hinge is arranged, wherein the holder has a first section, which extends transversely with respect to a longitudinal direction of the container body and thereby protrudes laterally from the container wall. This configuration renders it possible to arrange the hinge at a distance with respect to the container body.

In a preferred development of this inventive concept, provision is made that the holder has a second section, which is arranged on the first section and extends in the longitudinal direction of the container body. This also contributes to simple handling of the container body. Production is also simplified. In this case, it is particularly preferred if an intermediate space is formed between the second section and the container wall.

In accordance with a non-limiting embodiment of the invention, provision is made that in the open position of the lid, the sealing surface assumes a distance B with respect to the pivot axis, wherein the pivot axis is arranged at a distance B' with respect to the closest point of the inner side of the container wall and the distance B' is greater than the distance B. In this way, in the closed position of the lid, the sealing surface can be moved elastically towards the centre of the container body, in order to assume a distance B' with respect to the pivot axis, which is greater than the distance B. This also contributes to effective sealing.

In a further improvement, provision is made that the lid has a lid plate on which the sealing section is arranged. It is particularly preferred if the lid plate is round, in particular circular. The lid plate can be planar. Furthermore, an edge portion can be arranged on the lid plate and extends substantially perpendicularly with respect to the lid plate, wherein the edge portion at least partially surrounds the sealing section.

Handling of the container can be further improved, if the sealing section has, on its free end, a first sliding region, wherein the sliding region is arranged obliquely such that an outer diameter of the sealing section in the sliding region decreases towards the free end of the sealing section. Furthermore, the opening can be provided with an inner edge, of which the inner contour has a second sliding region, wherein the second sliding region is arranged obliquely such that an inner diameter of the opening increases in the sliding region towards the edge of the container body. In this case, provision can be made that the first and the second sliding regions slide one onto the other when the lid is being opened and/or closed. It is also advantageous, if the inner edge has a bead, wherein the inner diameter of the container body in the region of the bead is smaller than the inner diameter of the remaining container body.

In accordance with one advantageous embodiment of the invention, provision is made that the lid has an actuating section provided thereon which, in the closed position of the lid, protrudes laterally beyond the container. The actuating section can be arranged preferably on the side of the lid opposite the hinge. An actuating section formed in this manner simplifies in particular mechanical handling of the container because the actuating section can be mechanically grasped and moved in a particularly simple manner, in order to open and/or close the lid.

Preferably, the sealing section is formed in an annular manner and extends substantially perpendicularly with respect to the lid plate. In particular, provision can be made that the sealing section is formed in an annular manner.

A further improvement is achieved, if the outer side of the container body has a projecting section provided thereon, against which the edge portion comes to lie in the closed position. The projecting section can also be formed as a stop for the lid.

In accordance with the invention, it is particularly preferred, if no desiccant is arranged in or on the lid. In an advantageous manner, the desiccant can be accommodated in a desiccant container, which is introduced into the receiving space.

In accordance with a particularly advantageous embodiment of the invention, provision is made that the distance B is in a range of between ⅔ the distance A and 3 times the distance A. It is preferred, if the distance B is between 1 times and 2 times the distance A.

Further objectives, features, advantages and possible applications of the present invention will be apparent from the description hereinafter of exemplified embodiments with reference to the drawing. All of the described and/or figuratively illustrated features form the subject matter of the invention in their own right or in any meaningful combination, even irrespective of the combination in individual claims or dependency references thereof.

DETAILED DESCRIPTION

Figure 1:
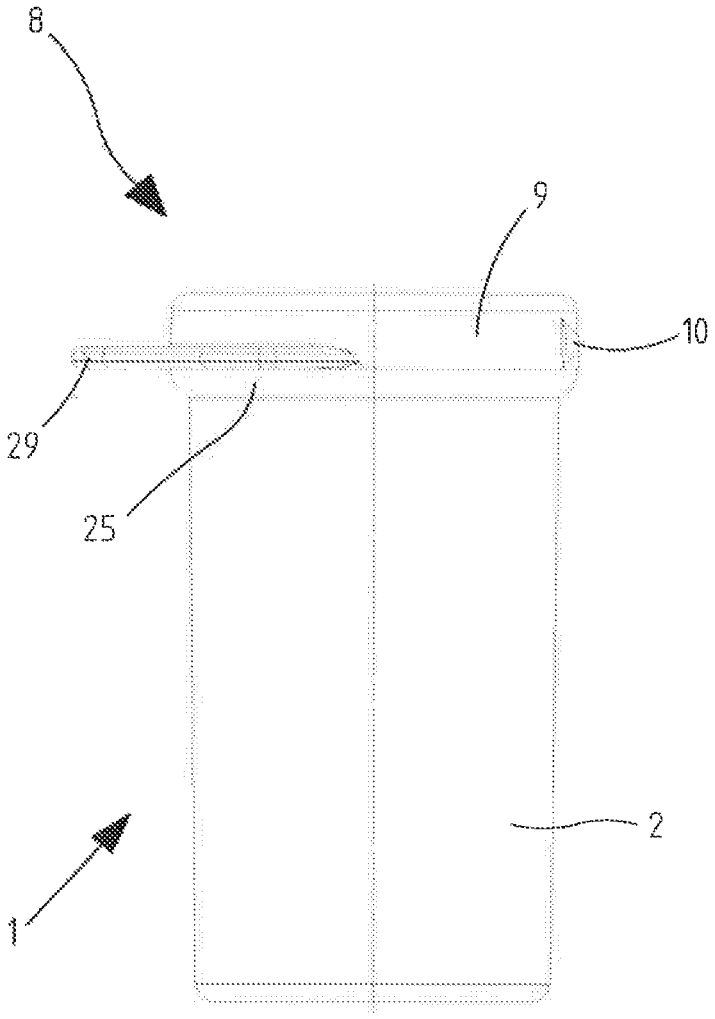
FIG. 1 shows a side view of one non-limiting embodiment of a container in accordance with the invention.
Figure 1A:
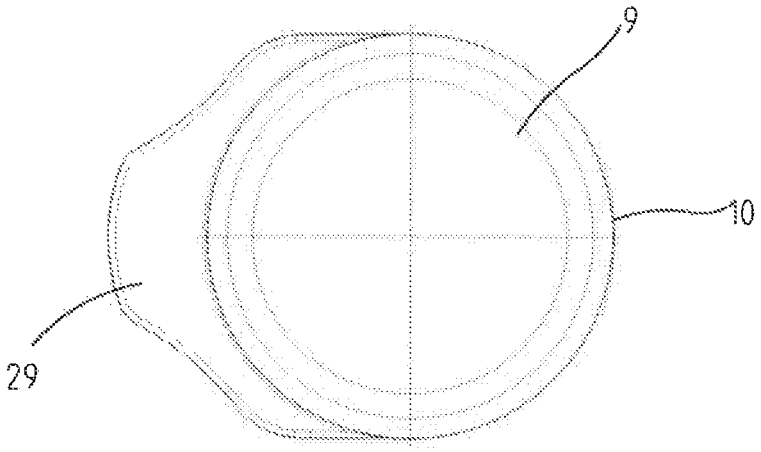
FIG. 1A shows the container of FIG. 1 from above.
Figure 2:
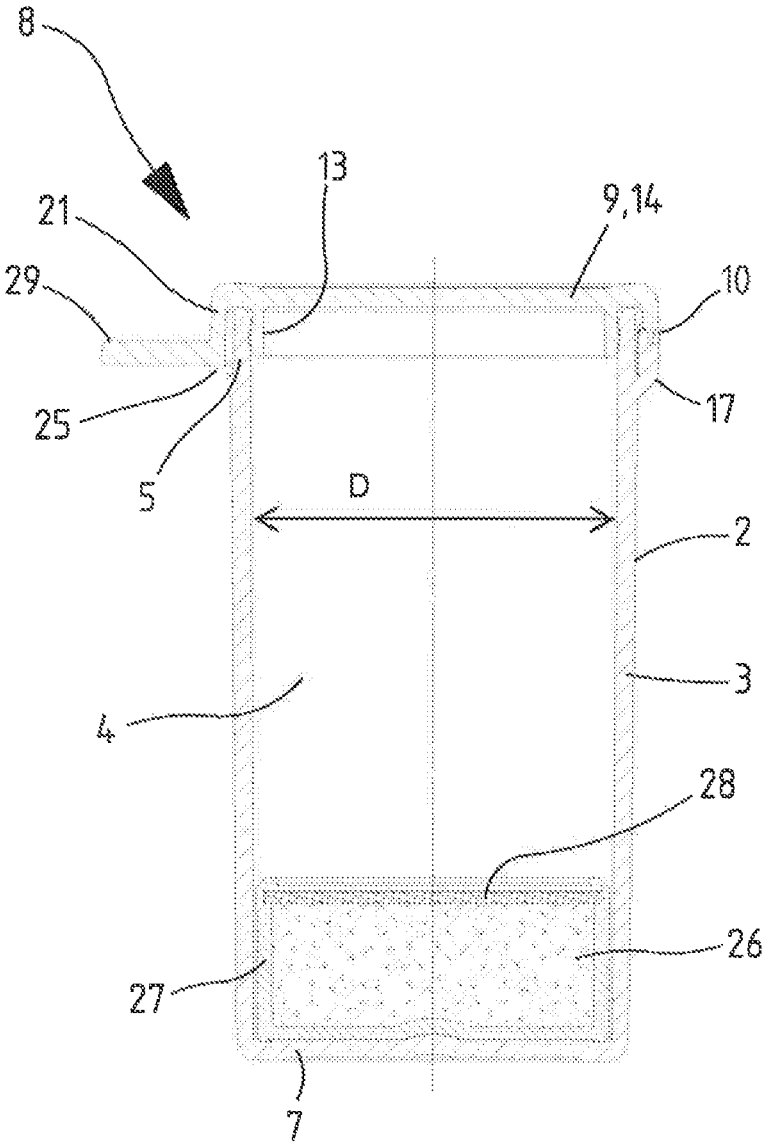
FIG. 2 shows a longitudinal sectional view of the container of FIG. 1 with the lid in the closed position.

Referring to FIGS. 1-6, an injection-molded container 1 for dry-storage of goods (not illustrated) to be packaged is exemplified. The injection-molded container is suitable for different goods to be packaged. It is particularly suitable for medical tablets as well as test strips and diagnostic dipsticks. The injection-molded container 1 has a container body 2 with a container wall 3. The container body 2 forms a receiving space 4 for the goods to be packaged. In the illustrated exemplified embodiment, the container body 2 is formed in a tubular manner; it has a cylindrical shape. The container body 2 has, in an end region 5, an opening 6 for discharging the goods to be packaged. A closed container base 7 is provided on the end of the container body 2 opposite the end region 5.

Figure 5:
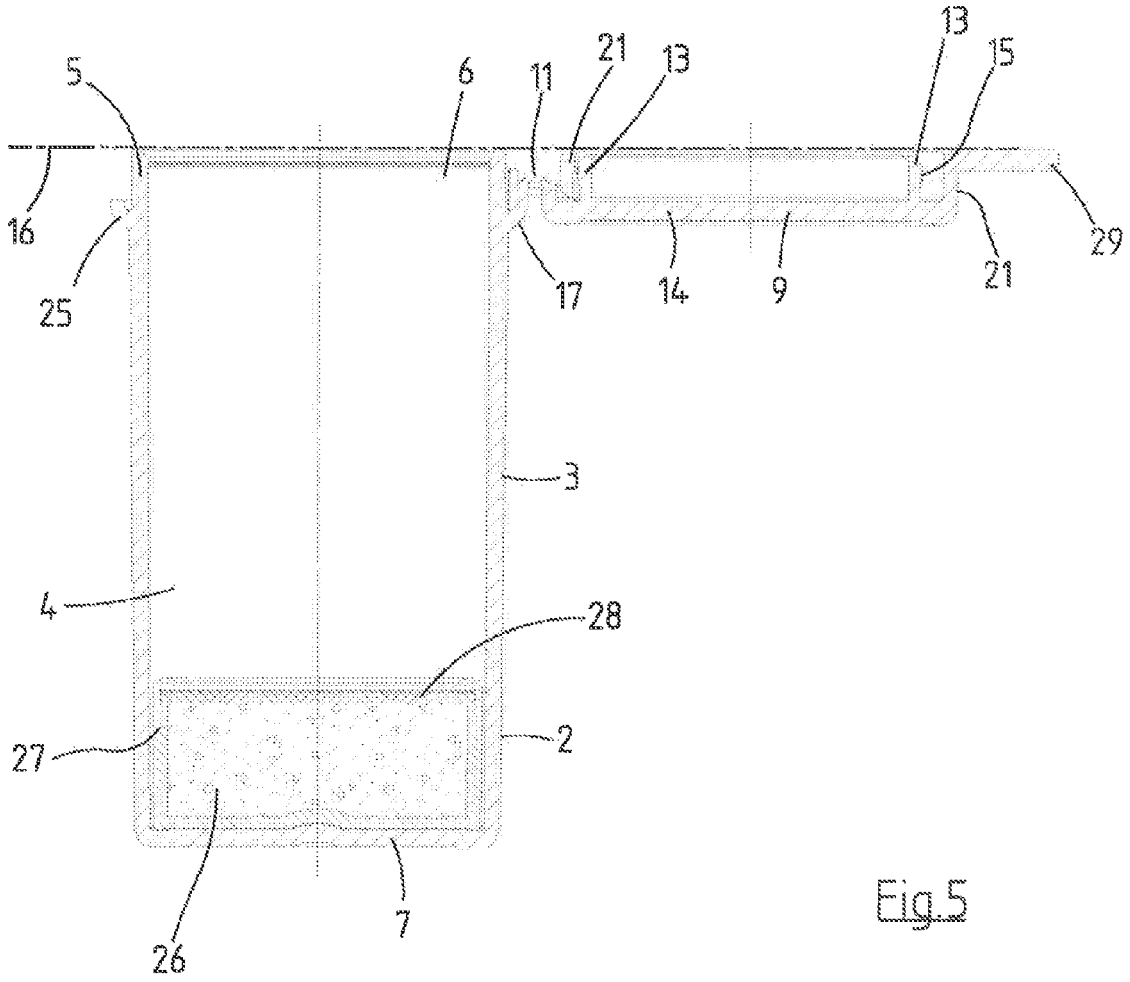
FIG. 5 shows a longitudinal sectional view of the container of FIG. 1 with the lid in the completely open position.
Figure 5A:
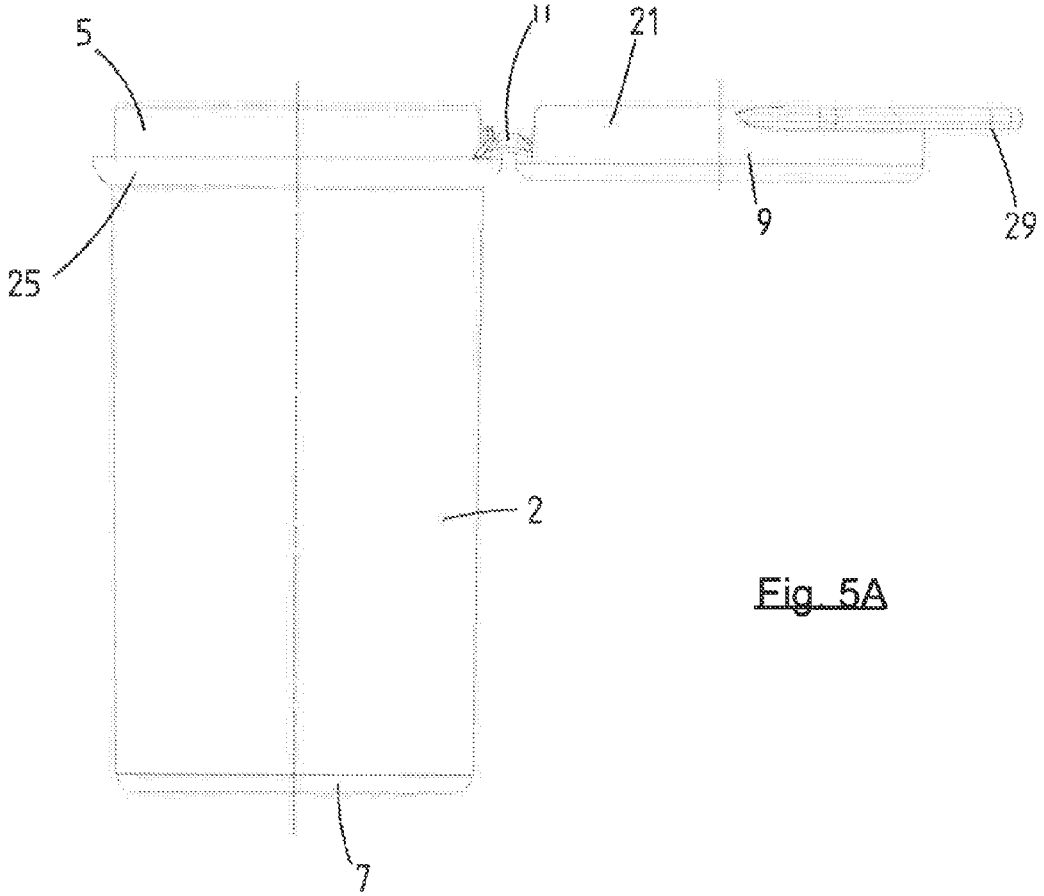
FIG. 5A shows a side view of the container of FIG. 5.
Figure 6:
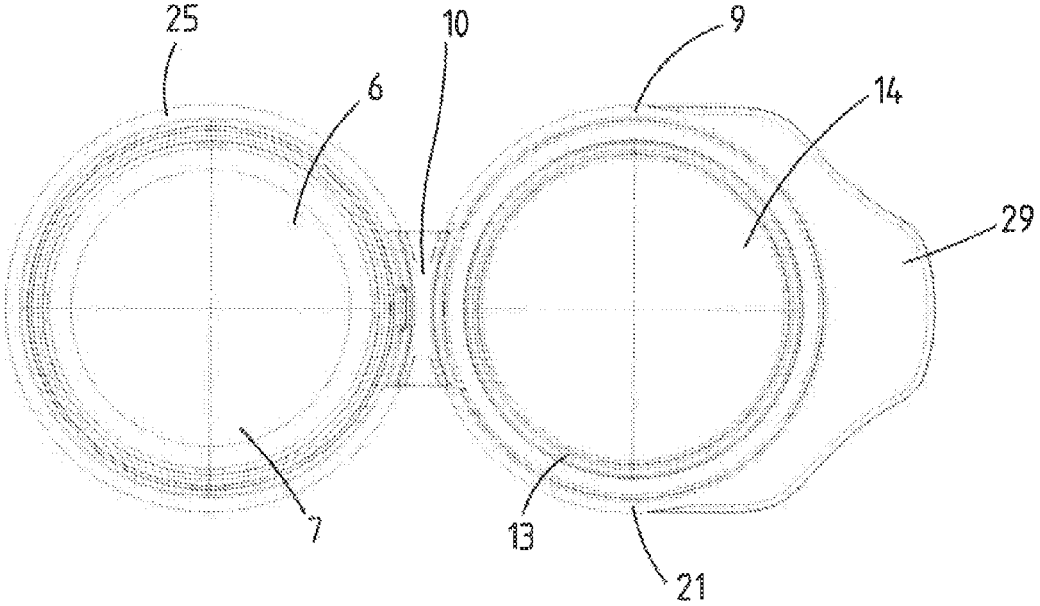
FIG. 6 shows a view of the container of FIG. 1 from above with the lid in the completely open position.

The container also has a closure 8 for closing the opening 6. The closure 8 comprises a lid 9 and a hinge 10. In the illustrated exemplified embodiment, the hinge 10 is formed as a film hinge and has a hinge section 12 (see FIG. 3A) with a reduced thickness. This produces mobility, which permits repeated opening and closing of the pivotable lid 9, wherein the lid 9 remains connected to the container body 2. In the illustrated exemplified embodiment, the closure 8 is formed as a flip-top closure. The pivot axis is a notional pivot axis. The lid 9 can be moved in a pivoting manner between a closed position (see FIGS. 1 and 2) and an open position (see FIGS. 5, 5A and 6).

The lid 9, the hinge 10 and the container body 2 are injection-molded in one piece from synthetic material in the injection-molded method. In this way, production is particularly cost-effective because the different components can be produced all at once in the injection-moulding method. Furthermore, handling is also particularly simple because the container body 2 does not have to be equipped with the lid at a later stage.

The lid 9 and the hinge 10 are formed and arranged on the container body 2 such that in the completely open position, the lid 9 does not protrude (in the longitudinal direction of the container body 2) beyond the end region 5 of the container body 2. This can be seen particularly clearly in FIGS. 5, 5A and 3A. Here, it is clearly illustrated that in the completely closed position, the lid 9 does not protrude beyond a boundary plane 16, which is defined by the outer boundary of the end region 5. The length of the injection-molded container 1 in the completely open position of the lid 9 is accordingly defined by the length of the container body 2. The lid 9 does therefore not increase the length of the injection-molded container 1.

Furthermore, the lid 9 has a sealing section 13. In the illustrated exemplified embodiment, the sealing section 13 is formed circumferentially in the manner of a circular ring. The sealing section 13 is arranged on the lid plate 14. In the closed position of the lid 3, the sealing section 13 is arranged in the opening 6 of the container body 2. This can be seen particularly clearly in FIG. 2. In this case, the sealing section 13 has a sealing surface 15, which, in the closed position of the lid 9, lies against the inner edge of the opening 6. The sealing surface 15 is formed by a region of the sealing section 13, which is formed as a seal. The sealing surface 15 is convexly curved.

Figure 3:
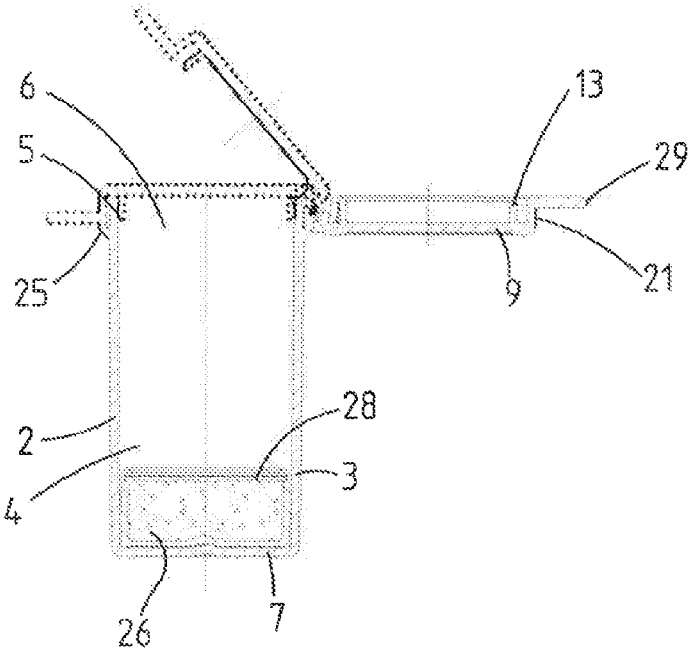
FIG. 3 shows a longitudinal sectional view of the container of FIG. 1 with the lid in the open position.
Figure 3A:
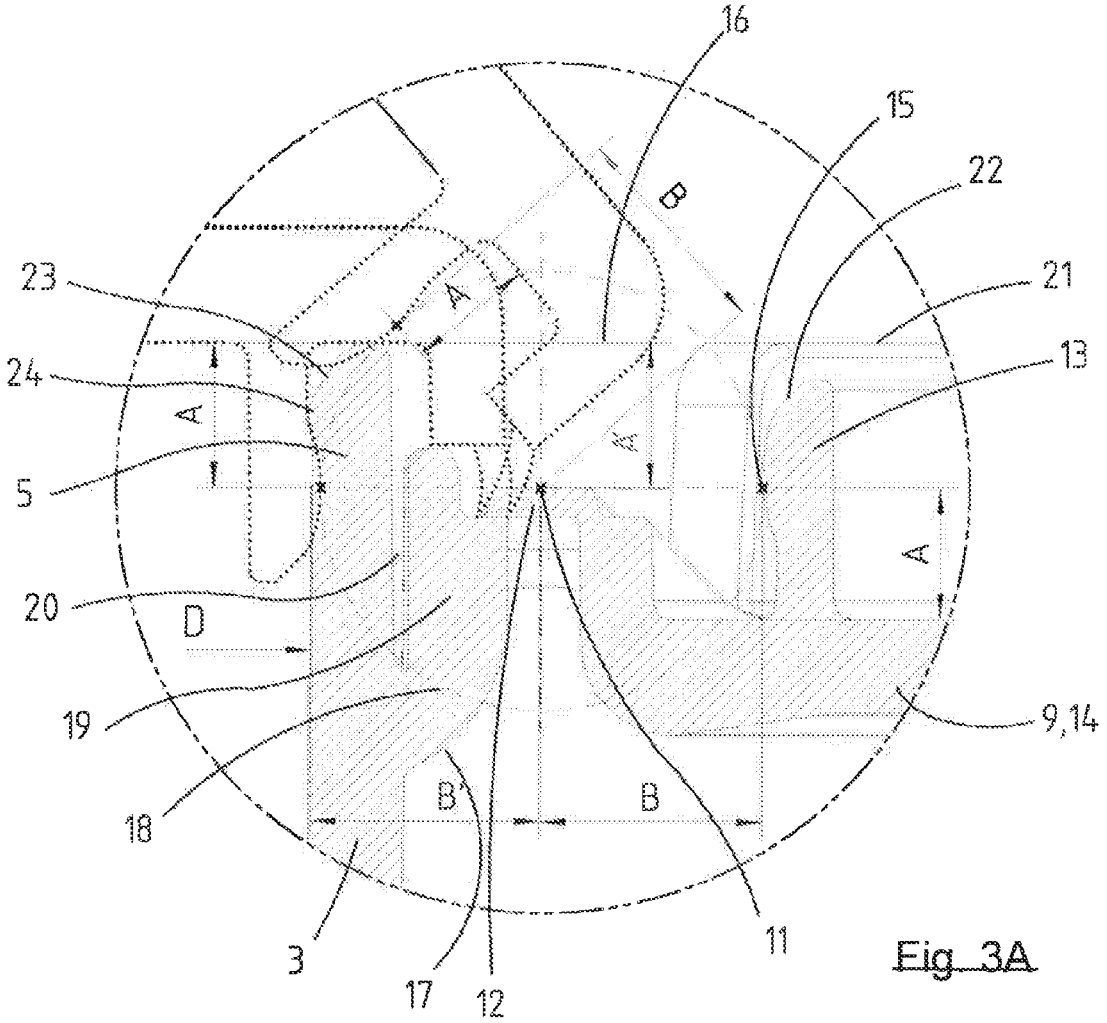
FIG. 3A shows an enlarged detail of the container of FIG. 3.
Figure 4:
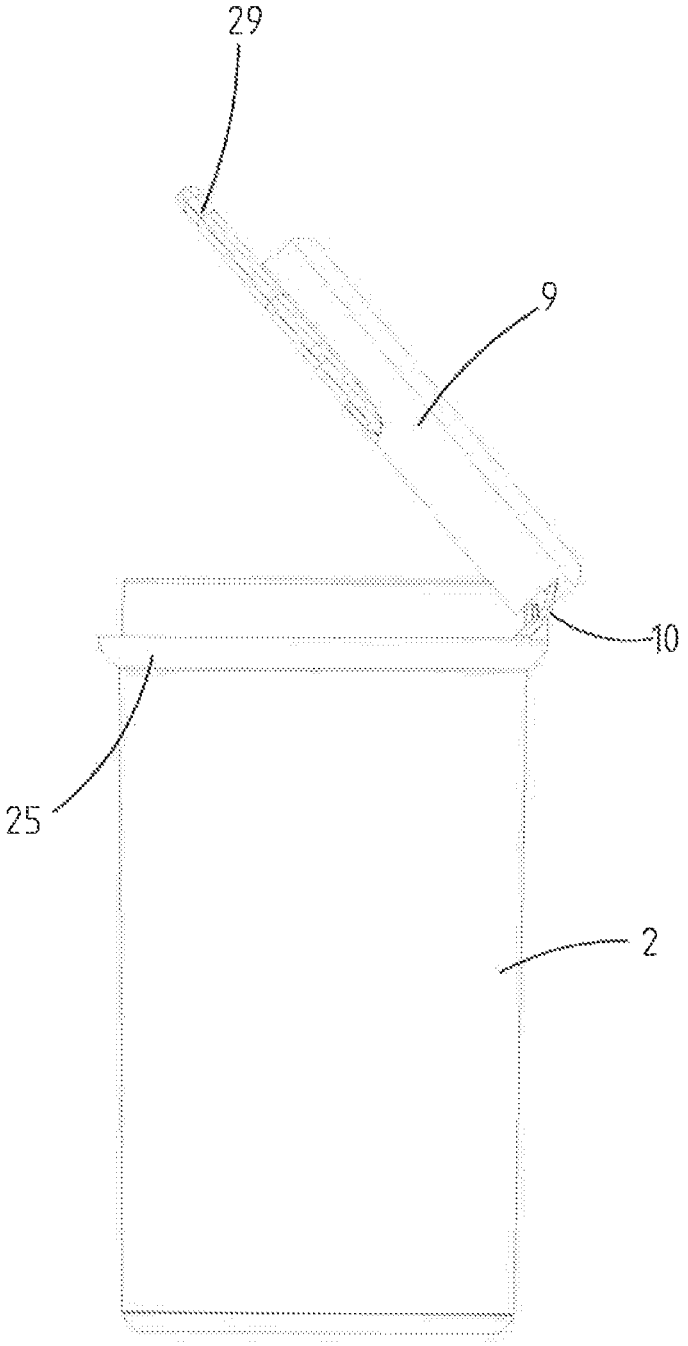
FIG. 4 shows a side view of the container of FIG. 1 with the lid in the partially open position.

It can also be seen in FIG. 3A that the distance A between the sealing surface 15 and the outer boundary plane 16 of the end region 5 amounts to between 90% and 110% of a distance A' between the pivot axis 11 and the outer boundary plane 16. In the illustrated exemplified embodiment, the distance A equals the distance A'.

It can also be seen in FIG. 3A that in the open position of the lid 9, the sealing surface 15 assumes a distance B with respect to the pivot axis 11. Furthermore, the pivot axis 11 is arranged such that it is arranged at a distance B' with respect to the closest point of the inner side of the container wall 3, wherein the distance B' is greater than the distance B.

Within the scope of the invention, provision can be advantageously made for the following. The stated ranges each contribute to an advantageous solution both in their own right and in combination with one or more of the other ranges.

The distance B is in a range between ⅔ of the distance A and 3 times the distance A. It is preferred, if the distance B is between 1 times and 2 times the distance A. It is particularly preferred if the distance B is between 1.2 times and 1.8 times the distance A. A distance B, which is 1.5 times the distance A, has proven to be particularly favourable.

The distance B is in a range between 1 times the distance A' and 2 times the distance A'. It is particularly preferred, if the distance B is between 1.2 times and 1.8 times the distance A'. A distance B, which is 1.5 times the distance A', has proven to be particularly favourable.

The distance A is in a range between ⅔ of the distance A' and 1.5 times the distance A'. It is particularly preferred, if the distance A amounts to between 90% and 110% of the distance A'.

In a preferred manner, the distance B' is between 0.5 mm and 2.0 mm greater than the distance B. It is particularly preferred, if the distance B' is between 0.5 mm and 1.0 mm greater than the distance B.

In a preferred manner, the inner diameter D of the container body 2 amounts to between 10 mm and 100 mm. For many applications, an inner diameter D between 20 mm and 30 mm, in particular between 22 mm to 26 mm, is particularly preferred.

In a preferred manner, the inner diameter D amounts to between 6 times and 12 times the distance B.

The container body 2 has a holder 17, on which the hinge 10 is arranged. The holder 17 has a first section 18. This portion extends transversely with respect to a longitudinal direction of the container body 2 and protrudes laterally on the container wall 3. Furthermore, the holder 17 has a second section 19. This portion is arranged on the first section 18 and extends in the longitudinal direction of the container body 2. An intermediate space 20 is formed between the second section 19 and the container wall 3. Furthermore, an edge portion 21 is arranged on the lid plate 14. The edge portion 21 is formed in the manner of a partial ring. It extends almost over the entire circumference of the sealing section 13, but has an aperture in the region of the hinge 10. The edge portion 21 is arranged at a distance with respect to the sealing section 13. In the illustrated exemplified embodiment, the edge portion 21 extends approximately in parallel with the sealing section 13. In the closed position of the lid 9, the edge of the container wall 3 can be accommodated in the gap formed between the sealing section 13 and the edge portion 21.

The sealing section 13 has, on its free end, a first sliding region 22. This can be seen particularly clearly in FIG. 3A. The sliding region 22 is arranged obliquely with respect to the longitudinal axis of the container body 2. The outer diameter of the sealing section 13 decreases in the sliding region 22 towards the free end of the sealing section 13. The opening 6 is provided with an inner edge, of which the contour forms a second sliding region 23. This sliding region is arranged, in turn, obliquely with respect to the longitudinal axis of the container body 2. In the second sliding region 23, the inner diameter of the opening 6 increases towards the edge of the container body 2.

FIG. 3 shows the opening position of the lid 9 in continuous lines. Furthermore, for illustrative purposes, the lid 9 is also shown in the closed position and in an intermediate position in dotted lines.

FIG. 3A also shows that the inner edge of the opening 6 has a bead 24. As a result, the inner diameter of the container body 2 in the region of the bead 24 is less than the inner diameter D of the adjoining container body 2.

It can also be seen in the figures that a laterally projecting section 25 is arranged on the outer side of the container body 2. The projecting section 25 is arranged in the end region 5 and is formed in a circumferential manner. It transitions into the holder 17 in the region of the hinge 10. The projecting section 25 forms a stop for the lid 9. In the closed position, the edge portion 21 comes to lie against the projecting section 25.

A desiccant chamber 26 is arranged in the container body 2. However, no desiccant is provided in or on the lid 9. In the illustrated exemplified embodiment, the desiccant chamber 26 is formed by a separate desiccant container 27, which is inserted into the receiving space 4. The desiccant container 27 has, on its side pointing to the opening 6, a moisture-permeable cover 28. This cover can consist e.g. of cardboard. The cover 28 forms a support surface for the goods to be packaged. The desiccant container 27 lies on the inner side of the container base 7. The desiccant, e.g. silica gel or a molecular sieve, can be arranged in the desiccant chamber 26.

Furthermore, the lid 9 has an actuating section 29. In the closed position of the lid 9, this actuating section protrudes laterally beyond the container body 2. In the illustrated exemplified embodiment, the actuating section 29 is arranged on the edge portion 21 and extends approximately at a right angle thereto.

The invention claimed is:

1. An injection-molded container for dry-storage of goods to be packaged, comprising:

a container body, having a container wall and forming a receiving space for goods to be packaged, wherein a desiccant is arranged in the receiving space, wherein the container body has, in an end region, an opening for removing the goods to be packaged, and comprising a closure for closing the opening, wherein the closure has a lid and a hinge, which forms a pivot axis, about which the lid can be pivoted, in order to move the lid between a closed position and an open position, wherein in the open position the lid is pivoted by at least 180° with respect to the closed position wherein the lid, the hinge and the container body are injection-molded in one piece, wherein the lid and the hinge are formed and arranged on the container body such that in the open position the lid does not protrude beyond the end region of the container body, wherein the lid has a sealing section which, in the closed position of the lid, is arranged in the opening of the container body and wherein the sealing section has a sealing surface which, in the closed position of the lid, lies against the inner edge of the opening, wherein a distance A between the sealing surface and an outer boundary plane of the end region of the container body amounts to between ⅔ and 1.5 times of a distance A' between the pivot axis and the outer boundary plane.

2. The injection-molded container according to claim 1, wherein a distance between the sealing surface and an outer boundary plane of the end region of the container body amounts to between 90% and 110% of a distance between the pivot axis and the outer boundary plane.

3. The injection-molded container according to claim 1, wherein the container body has a holder, on which the hinge is arranged, wherein the holder has a first section which extends transversely with respect to a longitudinal direction of the container body and thereby protrudes laterally from the container wall.

4. The injection-molded container according to claim 3, wherein the holder has a second section, which is arranged on the first section and extends in the longitudinal direction of the container body.

5. The injection-molded container according to claim 4, wherein an intermediate space is formed between the second section and the container wall.

6. The injection-molded container according to claim 1, wherein in the open position of the lid, the sealing surface assumes a first distance with respect to the pivot axis, wherein the pivot axis is arranged at a second distance with respect to the closest point of the inner side of the container wall and wherein the second distance is greater than the first distance.

7. The injection-molded container according to claim 1, wherein the lid has a lid plate, on which the sealing section is arranged.

8. The injection-molded container according to claim 7, wherein an edge portion is arranged on the lid plate and extends substantially perpendicularly with respect to the lid plate, wherein the edge portion at least partially surrounds the sealing section.

9. The injection-molded container according to claim 1, wherein the sealing section has, on its free end, a first sliding region, wherein the first sliding region is arranged obliquely such that an outer diameter of the sealing section decreases in the sliding region towards the free end of the sealing section.

10. The injection-molded container according to claim 1, wherein the opening is provided with an inner edge, of which the inner contour has a second sliding region, wherein the second sliding region is arranged obliquely such that an inner diameter of the opening increases in the sliding region towards the edge of the end region.

11. The injection-molded container according to claim 1, wherein the inner edge of the opening has a bead, wherein the inner diameter of the container body in the region of the bead is less than the inner diameter of the remainder of the container body.

12. The injection-molded container according to claim 1, wherein in reference to FIGS. 1-6, the distance B is in a range of between ⅔ of the distance A and 3 times the distance A.

13. An injection-molded container for storage of goods, comprising:

a container body having a container wall and forming a receiving space for goods to be packaged, wherein the container body has, in an end region, an opening for removing the goods to be packaged, and a closure for closing the opening, wherein the closure comprises a lid and a hinge, which forms a pivot axis, about which the lid can be pivoted, wherein the closure and the container body are injection-molded in one piece, wherein the hinge is a film hinge, wherein the closure is formed and arranged on the container body such that in the open position the hinge is adapted to position the lid such that the lid does not protrude beyond the end region of the container body, wherein the lid has a sealing section which, in the closed position of the lid, is arranged in the opening of the container body and wherein the sealing section has a sealing surface which, in the closed position of the lid, lies against the inner edge of the opening thereby sealing the container body, wherein the sealing surface assumes a distance B with respect to the pivot axis, wherein the pivot axis is arranged at a distance B' with respect to the closest point of the inner side of the container wall, wherein the distance B' is greater than the distance B, wherein when rotating the lid to a closed position the hinge is adapted to transversely move the lid and the sealing surface towards the centre of the container body.

14. The injection-molded container of claim 13, further comprising:

a desiccant disposed in a receiving space of the container body.

15. The injection-molded container of claim 14, wherein the desiccant is in a desiccant container.

16. The injection-molded container of claim 13, wherein the closure further comprises a holder on which the hinge is attached, wherein the holder attaches to the container body below the end region of the container body and extends upward towards the end region creating a space in between the container body and the holder.

17. The injection-molded container of claim 13, wherein the lid further comprises an edge portion, wherein the edge portion is formed in a partial ring and extends over the circumference of the sealing section.

18. The injection-molded container of claim 13, wherein a distance between the sealing surface and an outer boundary plane of the end region of the container body amounts to between 90% and 110% of a distance between the pivot axis and the outer boundary plane.

19. The injection-molded container of claim 13, wherein in the open position of the lid, the sealing surface assumes a first distance with respect to the pivot axis, wherein the pivot axis is arranged at a second distance with respect to the closest point of the inner side of the container wall and wherein the second distance is greater than the first distance.

20. The injection-molded container of claim 13, wherein the inner edge of the opening has a bead, wherein the inner diameter of the container body in the region of the bead is less than the inner diameter of the remainder of the container body.

21. An injection-molded container for storage of goods, comprising:

a container body having a container wall and forming a receiving space for goods to be packaged, wherein the container body has, in an end region, an opening for removing the goods to be packaged, and a closure for closing the opening, wherein the closure comprises a lid and a hinge, which forms a pivot axis, about which the lid can be pivoted, wherein the closure and the container body are injection-molded in one piece, wherein the hinge is a film hinge, wherein the lid has a sealing section which, in the closed position of the lid, is arranged in the opening of the container body and wherein the sealing section has a sealing surface which, in the closed position of the lid, lies against the inner edge of the opening thereby sealing the container body, wherein a distance between the sealing surface and an outer boundary plane of the end region of the container body amounts to between 90% and 110% of a distance between the pivot axis and the outer boundary plane.

* * * * *